US010626634B2

(12) United States Patent
Verderaime et al.

(10) Patent No.: US 10,626,634 B2
(45) Date of Patent: Apr. 21, 2020

(54) ANTI-BARRICADING TURN HUB ASSEMBLY FOR A DOOR LOCKSET

(71) Applicant: Schlage Lock Company LLC, Carmel, IN (US)

(72) Inventors: Steven Verderaime, Colorado Springs, CO (US); Adam M. Litwinski, Centennial, CO (US); Jonathan M. Carron, Colorado Springs, CO (US); Drake Lunday, Colorado Springs, CO (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 15/897,782

(22) Filed: Feb. 15, 2018

(65) Prior Publication Data

US 2019/0242154 A1 Aug. 8, 2019

Related U.S. Application Data

(60) Provisional application No. 62/625,638, filed on Feb. 2, 2018.

(51) Int. Cl.
*E05B 13/00* (2006.01)
*E05B 63/00* (2006.01)
(Continued)

(52) U.S. Cl.
CPC ..... *E05B 13/005* (2013.01); *E05B 1/0007* (2013.01); *E05B 15/04* (2013.01);
(Continued)

(58) Field of Classification Search
CPC ..... E05B 13/005; E05B 15/04; E05B 1/0007; E05B 2015/0403; E05B 2015/0458; E05B 2015/105; E05B 63/0069
(Continued)

(56) References Cited

U.S. PATENT DOCUMENTS 1,471,553 A * 10/1923 Fell ..... B60R 25/0222 70/221
1,611,940 A * 12/1926 Ohmer ..... G07B 13/005 251/297
(Continued)

FOREIGN PATENT DOCUMENTS

EP 1223270 8/2006
GB 2334546 8/1999
(Continued)

OTHER PUBLICATIONS

International Search Report; International Searching Authority; International Patent Application No. PCT/US2019/016509; dated Apr. 30, 2019; 2 pages.
(Continued)

*Primary Examiner* — Lloyd A Gall
(74) *Attorney, Agent, or Firm* — Taft Stettinius & Hollister LLP

(57) ABSTRACT

An anti-barricading turn hub assembly is configured for use with a lockset including a bolt movable to lock and unlock a door. The anti-barricading turn hub assembly includes a spindle connected to a thumb turn on one side of the lock. The spindle is releasably engaged to a turn hub that is operable by the key from the other side of the door. Under normal operation, the spindle and turn hub rotate together to lock and unlock the bolt. In a barricading situation in which the thumb turn is held to prevent the turn hub assembly from rotating, the turn hub disengages from the spindle upon application of sufficient force through rotation of the key, and the disengaged turn hub can be rotated to unlock the bolt even if the thumb turn is held to keep the spindle from rotating.

24 Claims, 5 Drawing Sheets

(51) Int. Cl.
*E05B 1/00* (2006.01)
*E05B 15/04* (2006.01)

(52) U.S. Cl.
CPC ..... *E05B 2015/0403* (2013.01); *E05B 2015/0458* (2013.01)

(58) Field of Classification Search
USPC ..... 70/222, 218, 223, 422, 495, 496
See application file for complete search history.

(56) References Cited

U.S. PATENT DOCUMENTS 4,656,850 A * 4/1987 Tabata ..... E05B 47/0673 292/144
4,922,737 A 5/1990 Urby
4,941,697 A * 7/1990 Fan ..... E05B 17/0058 292/252
4,995,248 A * 2/1991 Liu ..... E05B 47/0692 70/107
5,010,755 A * 4/1991 Best ..... E05B 17/0058 70/222
5,040,652 A 8/1991 Fish et al.
5,542,274 A * 8/1996 Thordmark ..... E05B 47/063 70/277
5,640,863 A * 6/1997 Frolov ..... E05B 47/0692 70/149
5,787,743 A 8/1998 Weigard
5,794,472 A 8/1998 Kester et al.
5,816,085 A * 10/1998 Winardi ..... E05B 47/0673 70/283
RE36,209 E 5/1999 Walls
6,053,019 A * 4/2000 Wiik ..... E05B 47/0673 70/283
6,286,347 B1 * 9/2001 Frolov ..... E05B 47/0692 192/71
6,523,381 B1 * 2/2003 Ritz ..... E05B 29/00 70/492
6,543,264 B2 * 4/2003 Frolov ..... E05B 13/005 70/106
6,581,423 B2 * 6/2003 Lin ..... E05B 47/0692 292/DIG. 27
6,591,644 B2 * 7/2003 Doerr ..... E05B 47/063 70/278.3
6,598,909 B2 * 7/2003 Lu ..... E05B 47/0012 292/144
6,651,468 B2 * 11/2003 Aramburu ..... E05B 13/005 70/189
6,837,081 B2 * 1/2005 Ruano Aramburu ..... E05B 47/0692 70/189
6,904,777 B2 * 6/2005 Kehr ..... B62H 5/04 70/252
7,222,508 B2 * 5/2007 Dickhans ..... E05B 47/0012 70/278.3
7,308,810 B2 * 12/2007 Menta San Miguel ..... E05B 47/0012 70/189
7,472,571 B1 * 1/2009 Chang ..... E05B 13/10 292/DIG. 27
7,698,918 B2 * 4/2010 Geringer ..... E05B 47/0676 292/DIG. 66
7,963,134 B2 6/2011 Rafferty et al.
8,141,400 B2 3/2012 Sorensen et al.
8,347,672 B2 1/2013 Hahecke
8,353,188 B1 1/2013 Byerly et al.
8,979,428 B2 3/2015 Ferraiolo
9,834,956 B2 * 12/2017 Hogan ..... E05B 13/005
2003/0033839 A1 2/2003 Chen et al.
2003/0106350 A1 6/2003 Char et al.
2010/0327611 A1 12/2010 Rees
2017/0183892 A1 6/2017 Kaukinen

FOREIGN PATENT DOCUMENTS

GB 2469652 5/2014
WO 2008043150 4/2008

OTHER PUBLICATIONS

Written Opinion; International Searching Authority; International Patent Application No. PCT/US2019/016509; dated Apr. 30, 2019; 5 pages.

* cited by examiner

ANTI-BARRICADING TURN HUB ASSEMBLY FOR A DOOR LOCKSET

CROSS-REFERENCE TO RELATED APPLICATIONS

The present application claims the benefit of the filing date of U.S. Provisional Application Ser. No. 62/625,638 filed on Feb. 2, 2018.

TECHNICAL FIELD

The present disclosure generally relates to a lockset for a door, and more particularly but not exclusively relates to a turn hub assembly for the lockset that is configured to prevent barricading.

BACKGROUND

Locksets can be provided that have a lock with a bolt that is operated by a key from one side of the door and a thumb turn on the other side of the door. Key operation of the lock can be blocked by someone holding the thumb turn to barricade the door to prevent the lock cylinder from being fully rotated by the key to retract the bolt. This can be problematic in certain situations, such as in schools, hospitals, behavioral health facilities, prisons, and public spaces where access to a space secured by the lock by proper authorities needs to be provided at all times.

Prior attempts to prevent barricading of a door by using the lock require a replacement of the lock trim, or only provide for the bolt to be retracted. These devices are not located within the lock case and may be able to be tampered with. In addition, these prior attempts may not work with deadbolt type locks. Therefore, a need remains for further improvements in this technological field.

SUMMARY

An exemplary anti-barricading turn hub assembly is configured for use with a lockset including a bolt operable to move in an locking or extending direction and an unlocking or retracting direction to lock and unlock a door. The anti-barricading turn hub assembly rotates to lock and unlock the bolt, and includes a spindle connected to a thumb turn on one side of the lock. The spindle is also releasably engaged to a turn hub that is connected to the lock cylinder for operation by a key from the other side of the door. Under normal operation, the spindle and turn hub rotate together to lock and unlock the bolt by using either the key or the thumb turn. In a barricading situation in which the thumb turn is held to prevent the hub assembly from rotating, the turn hub disengages from the spindle upon application of sufficient force through rotation of the key, and the disengaged turn hub can be rotated to unlock the bolt even if the thumb turn is held to keep the spindle from rotating. Further embodiments, forms, features, and aspects of the present application shall become apparent from the description and figures provided herewith.

DETAILED DESCRIPTION OF ILLUSTRATIVE EMBODIMENTS

Figure 1:
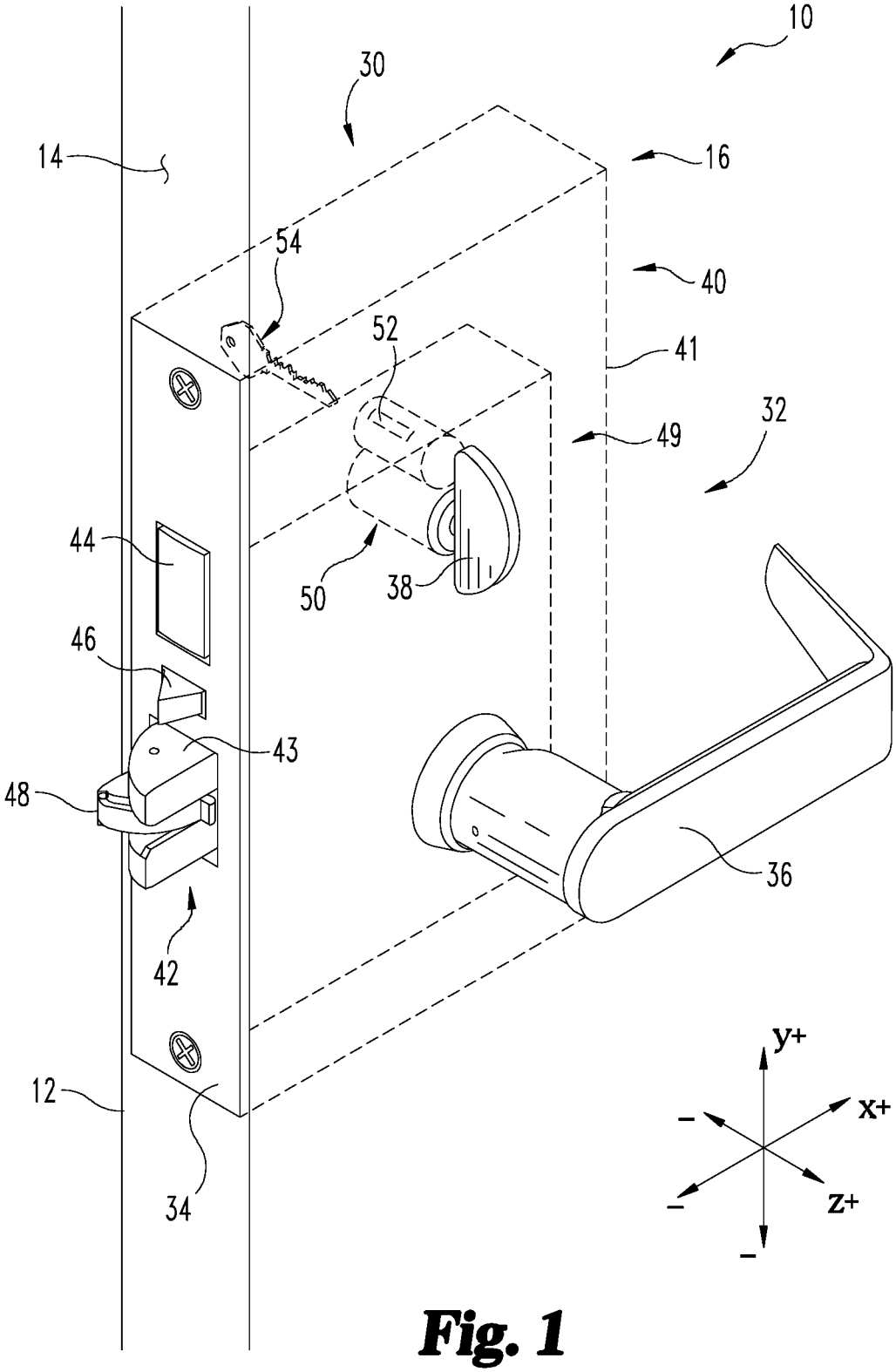
FIG. 1 illustrates a closure assembly with a lockset according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

As used herein, the terms "lateral," "longitudinal," and "transverse" are used to denote motion or spacing along three mutually perpendicular axes, wherein each of the axes defines two opposite directions. In the coordinate system illustrated in FIG. 1, the X-axis defines first (+) and second (−) lateral directions, the Y-axis defines first and second longitudinal directions, and the Z-axis defines first and second transverse directions. The longitudinal directions defined by the Y-axis may alternatively be referred to herein as the upward direction ($Y^+$) and the downward ($Y^-$) direction, and the transverse directions defined by the Z-axis may alternatively be referred to herein as the forward direction ($Z^+$) and the rearward direction ($Z^-$). In the orientation illustrated in FIG. 1, the lateral axis (X) and transverse axis (Z) are horizontal axes, and the longitudinal axis (Y) is a vertical axis. However, it is to be appreciated that these terms are used for ease and convenience of description, and are without regard to the orientation of the system with respect to the environment. For example, descriptions that reference a longitudinal direction may be equally applicable to a vertical direction, a horizontal direction, or an off-axis orientation with respect to the environment.

Furthermore, motion or spacing along a direction defined by one of the axes need not preclude motion or spacing along a direction defined by another of the axes. For example, elements which are described as being "laterally offset" from one another may also be offset in the lateral, longitudinal and/or transverse directions, or may be aligned in the lateral, longitudinal and/or transverse directions. The terms are therefore not to be construed as limiting the scope of the subject matter described herein.

Figure 2:
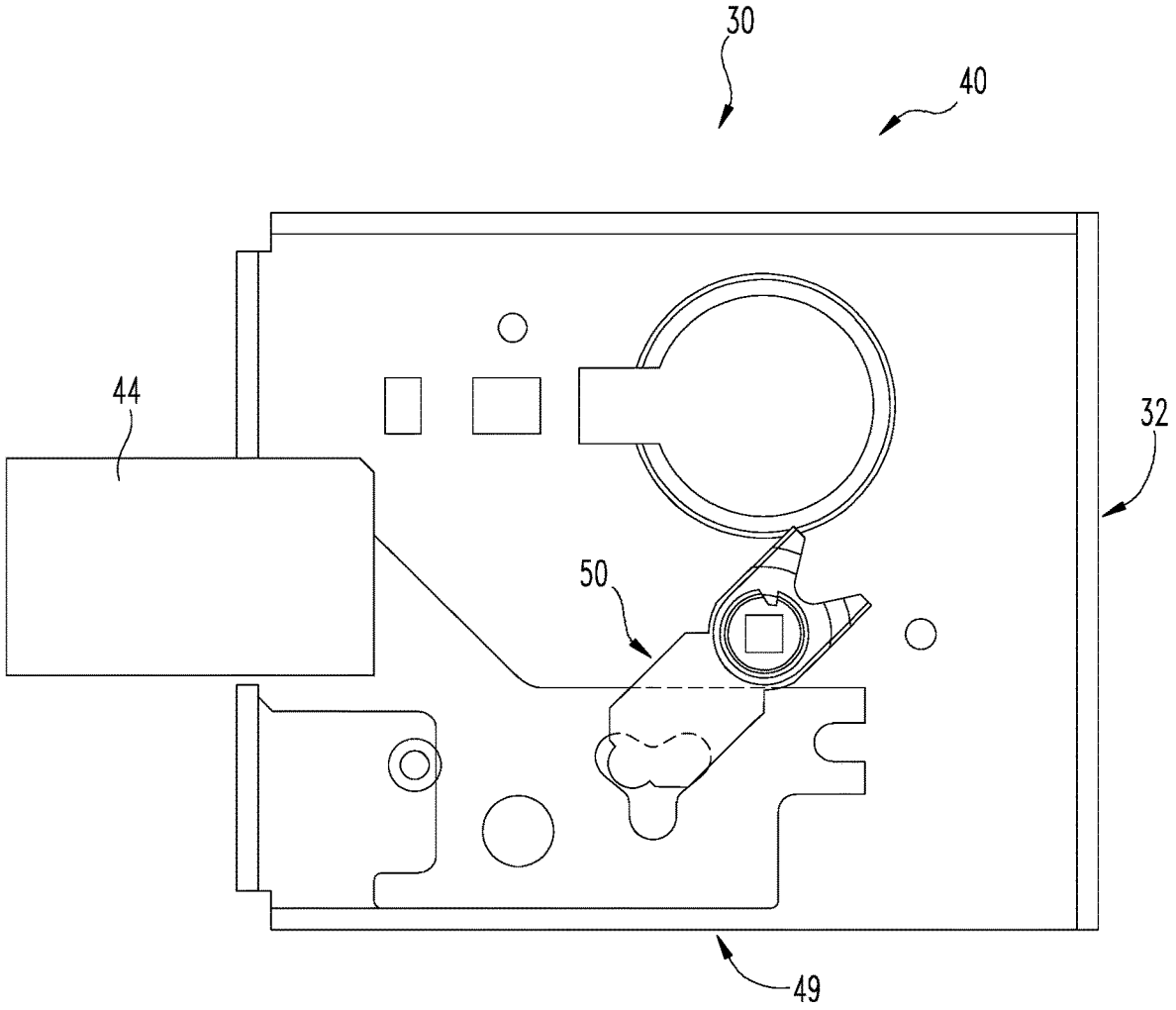
FIG. 2 is a schematic of a part of the lockset of FIG. 1 and shows an anti-barricading turn hub assembly.

With reference to FIGS. 1-2, illustrated therein are a closure assembly 10 and a lockset 30, according to certain embodiments. The closure assembly 10 includes a door 12, and may further be considered to include the lockset 30. The door 12 includes a free edge 14 and a door cutout 16 that extends from the free edge 14, and in which at least a portion of the lockset 30 is seated. The door 12 is pivotally mounted to a frame (not shown) for swinging movement between an open position in which the free edge 14 is offset from a side jamb (not shown), and a fully-closed position in which the free edge 14 is aligned with the side jamb.

In the illustrated embodiment, the lockset 30 is provided in the form of a mortise lockset, and includes a trim assembly 32 mounted to the face of the door 12, and a mortise chassis 40 seated in the door cutout 16. The lockset 30 also includes a faceplate 34 that is secured to the free edge 14 of the door 12, thereby retaining the chassis 40 within the door cutout 16. The trim assembly 32 includes a first manual actuator 36 and a second manual actuator 38, which in the illustrated embodiment are provided in the form of a handle 36 and a thumb turn 38. One example of a suitable mortise lockset is disclosed in U.S. Pat. No. 8,997,534 which is incorporated herein by reference, although other types of locksets and mortise locksets are also contemplated herein.

The chassis 40 includes a latchbolt 42, a deadbolt 44, and a mortise case 41 in which the bolts 42, 44 are movably mounted. The chassis 40 may further include a trigger 46, which in the illustrated form is movably mounted between the latchbolt 42 and the deadbolt 44. Each of the latchbolt 42 and the deadbolt 44 is movable between an extended position in which the bolt 42/44 projects beyond the faceplate 34 and is operable to engage the strike box (not shown), and a retracted position in which the bolt 42/44 is positioned at least primarily within the case 41. Similarly, the trigger 46 is movable between a projected position in which the trigger 46 projects beyond the faceplate 34, and a depressed position in which the trigger 46 is positioned at least primarily within the case 41. The latchbolt 42 is biased toward its extended position, and the trigger 46 is biased toward its projected position. The latchbolt 42 includes a latchbolt head 43, and may further include a tongue 48 movably mounted to the latchbolt head 43. The tongue 48 may facilitate movement of the latchbolt 42 between its extended and retracted positions, for example by reducing or counteracting resistive forces resulting from frictional engagement with the faceplate 34, the case 41 and/or the strike box.

The chassis 40 further includes a transmission assembly 49 that is operatively connected with the trim assembly 32, the latchbolt 42, and the deadbolt 44. More specifically, the transmission assembly 49 drivingly connects the handle 36 with the latchbolt 42, and drivingly connects the thumb turn 38 with the deadbolt 44. As a result, the handle 36 is manually operable to drive the latchbolt 42 from its extended position to its retracted position, and the thumb turn 38 is manually operable to drive the deadbolt 44 between its extended and retracted positions. In one embodiment, the transmission assembly 49 is also operatively connected with the trigger 46.

In certain embodiments, the transmission assembly 49 may connect the deadbolt 44 with one or more other components of the lockset 30 to provide for automatic movement of the deadbolt 44 in response to one or more actions. For example, the transmission assembly 49 may be configured to retract the deadbolt 44 in response to actuation of the handle 36, thereby providing for automatic unlocking when the lockset 30 is operated from the secured side of the door 12. As another example, the transmission assembly 49 may interconnect the latchbolt 42, the deadbolt 44, and the trigger 46 to provide for automatic extension of the deadbolt 44 when the door 12 is driven to its closed position. In such forms, the transmission assembly 49 may be configured to drive the deadbolt 44 toward its extended position in response to extension of the latchbolt 42 when the trigger 46 is in its depressed position, thereby providing for automatic locking when the door 12 is closed. The transmission assembly 49 may also include a turn hub assembly 50 connected to one or both of bolts 42/44 that is operable to extend or retract bolts 42/44 by manual operation of thumb turn 38 on one side of door 12 and/or a key 54 inserted in a keyway 52 of a lock cylinder on the other side of the door 12. The transmission assembly 49 may be provided in any of a number of forms known within the art, and the manner in which transmission assembly 49 performs the above-described functions need not be described in further detail herein.

When the door 12 is in its closed position and the bolts 42/44 move toward the extended positions thereof, the bolts 42/44 travel in the second lateral ($X^-$) direction. When the bolts 42/44 are subsequently moved toward the retracted positions thereof, the bolts 42/44 travel in the first lateral ($X^+$) direction. Accordingly, the second lateral ($X^-$) direction and the first lateral ($X^+$) direction may alternatively be referred to as the bolt-extending ($X^-$) direction and the bolt-retracting ($X^+$) direction, respectively.

During operation of the closure assembly 10, the door 12 may be driven from its open position to its closed position. When the door 12 approaches its fully-closed position, the latchbolt 42 enters the latchbolt opening of the strike box as the chassis 40 returns the latchbolt 42 to its extended position. With the trigger 46 retained in its depressed position, the transmission assembly 49 may drive the deadbolt 44 toward its extended position in response to extension of the latchbolt 42, thereby causing the deadbolt 44 to enter the deadbolt opening of the strike box. Alternatively or additionally, the deadbolt 44 may be driven to its extended position by manual operation of the thumb turn 38, and the deadbolt 44 may be driven to its extended position by manual operation of key 54 inserted in keyway 52 for rotation of the turn hub assembly 50 from the other side of door 12. With the bolts 42, 44 received in the openings of the strike box, the door 12 is secured in its closed position relative to the frame.

A person or persons may barricade his or her self in a room or area secured by door 12 by holding handle 36 and/or thumb turn 38 to defeat retracting bolt 42/44 by operation of key 54. As shown in FIGS. 3-5B, turn hub assembly 50 is configured to defeat barricading by allowing the bolt 42/44 to retract via operation of the key 54 even if handle 36 and/or thumb turn 38 is held stationary.

Turn hub assembly 50 includes a cylindrical spindle 60 that includes an elongated body 62 extending along a center axis A. Body 62 includes a central passage 64 extending on center axis A that opens at opposite first and second ends 66, 68 of body 52. First end 66 includes a lip 70 adjacent thereto projecting circumferentially around body 62. Second end 68 includes a circumferentially extending recess 72 adjacent thereto that extends around body 62. Body 62 also includes an axially extending groove 74 that extends between first and second ends 66, 68 through the lip 70 and recess 72. In the illustrated embodiment, central passage 64 is non-circular and is engaged with the thumb turn 38 so that rotation of the thumb turn 38 rotates the spindle 60. The non-circular shape is a square shape in the illustrated embodiment, however other non-circular shapes are also contemplated. In still other embodiments, central passage 64 is circular is fixedly engaged for rotation via thumb turn 38 via other means, such as a fastener, weld, adhesive or the like.

Turn hub assembly 50 further includes a turn hub 80 that includes a turn hub body 82 that defines a bore 84 to receive the spindle 60 therein. Hub body 82 also includes an elongated slot 86 that extends along the bore 84 and opens into bore 84. Hub body 82 also includes a key operating surface 88 that is engaged with the transmission assembly 49 so that the key 54 can rotate turn hub 80 about center axis A. In one embodiment, in the installed position of lockset 30 the center A is aligned with or parallel to the transverse axis (Z).

Figure 4:
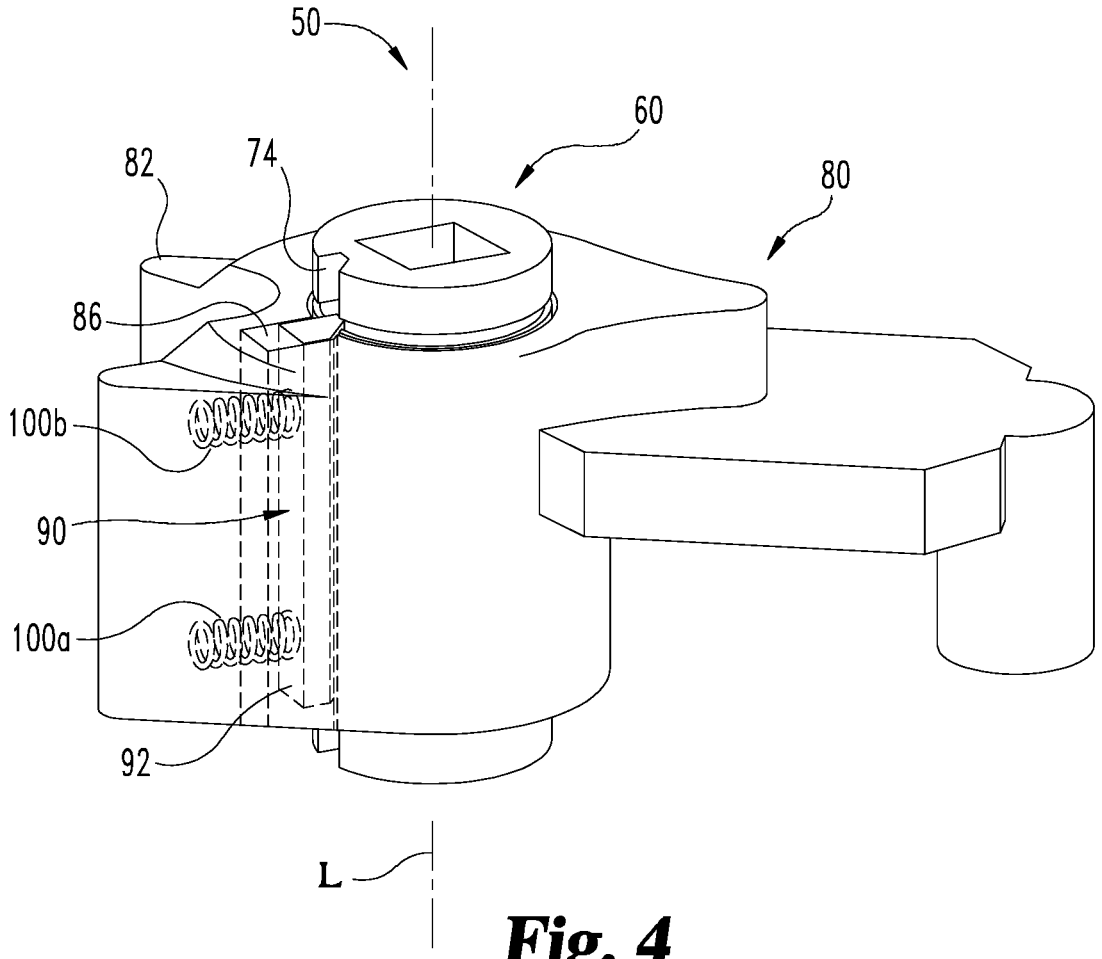
FIG. 4 is a perspective assembly view of the turn hub assembly of FIG. 2.
Figure 5A:
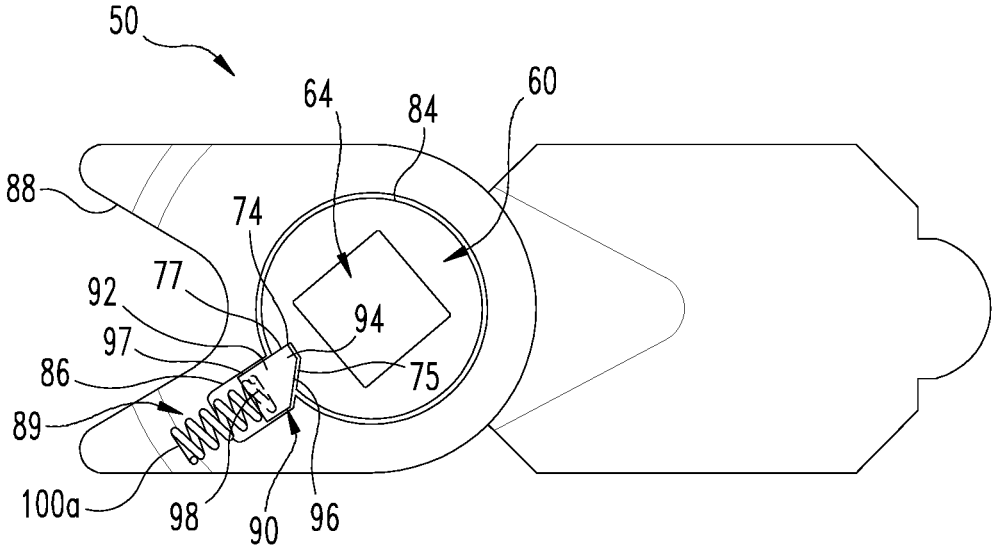
FIG. 5A is a section view of the turn hub assembly of FIG. 2 showing the clutching mechanism in an engaged position.
Figure 5B:
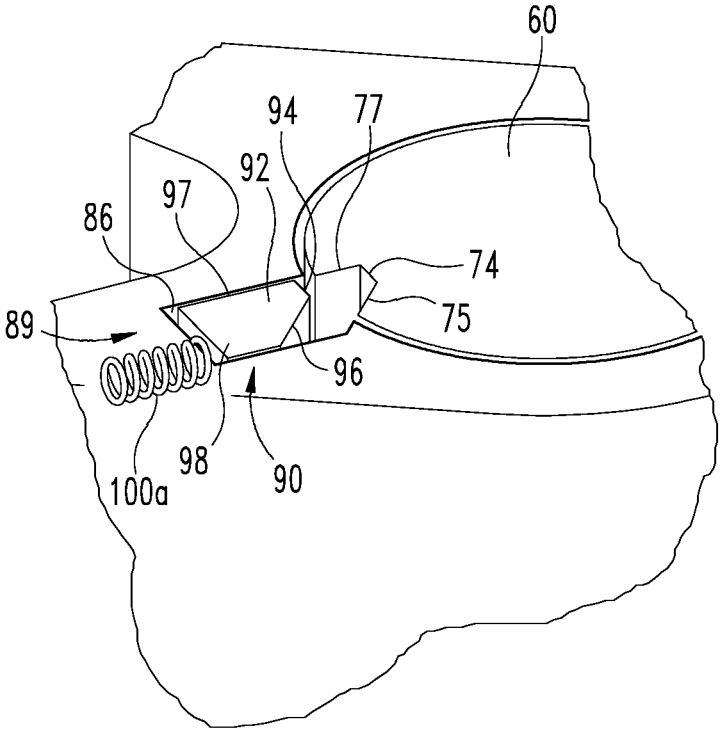
FIG. 5B is a section view of the turn hub assembly of FIG. 2 showing the clutching mechanism in a disengaged position.

Turn hub assembly 50 also includes a clutching mechanism 89 to releasably engage the spindle 60 and turn hub 80 to one another. In one embodiment, the clutching mechanism 89 includes a side bar 90 that is located in slot 86 and groove 74 to releasably engage turn hub 80 to spindle 60 such as shown in FIG. 4 and FIG. 5A. Side bar 90 includes an elongated body 92 with a tapered nose 94 that extends along one of the elongated sides of body 92 and a rectangular portion 98 along the opposite side of the body 92. Rectangular portion 98 includes an elongated flat sidewall 97 that abuts vertical sidewall 77 of groove 74, and sidewall 77 is perpendicular to the outer surface of spindle 60. As shown in FIGS. 5A and 5B, the tapered nose 94 includes a cam surface 96 that is obliquely oriented to the sidewalls of the rectangular portion 98 of the body 92. The tapered nose 94 is received in a correspondingly shaped groove 74 in the engaged position so that a sloped sidewall 75 of groove 74 contacts the oblique side of nose 94.

Figure 3:
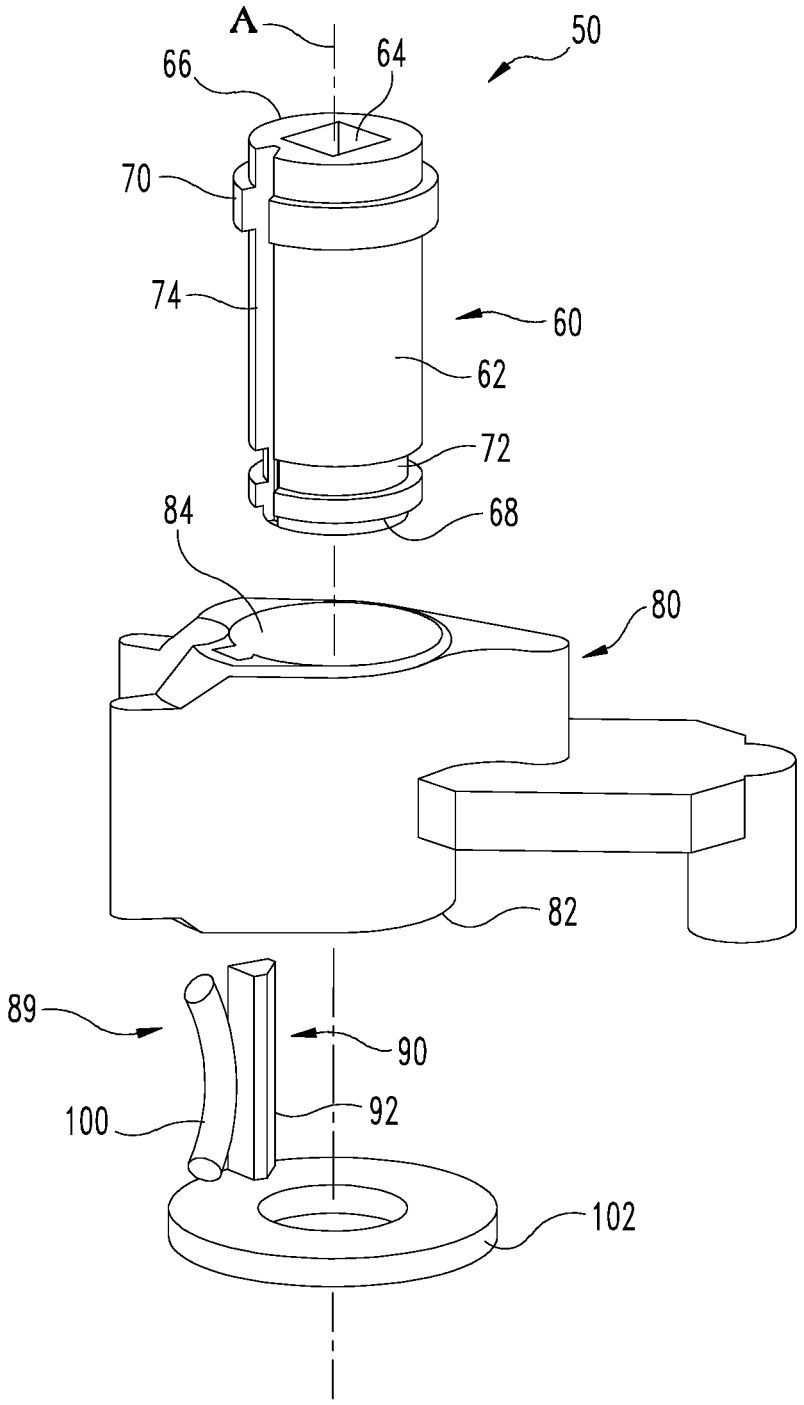
FIG. 3 is an exploded perspective view of the turn hub assembly of FIG. 2.

Side bar 90 is spring biased into groove 74 with one or more biasing members in slot 86. The one or more biasing members can be an elongated leaf spring 100 such as shown in FIG. 3, or two or more coil springs 100*a*, 100*b* spaced along side bar 90 as shown in FIG. 4. A retaining member 102 such as a washer can be engaged at one or both of the ends 66, 68 of spindle 60 to retain the side bar 90 in slot 86 and groove 74. In other embodiments, the arrangement of side bar 90 relative to spindle 60 and turn hub 80 is reversed so that the spindle 60 includes a groove configured to house the springs or other biasing member and the side bar 90 retracts into the groove 74 to disengage the turn hub 80 from spindle 60. In still other embodiments, a clutching mechanism 89 is provided that includes a ball-detent arrangement in which the ball and a spring are housed in one of the spindle 60 and turn hub 80 and biased to normally engage the detent in the other of the spindle 60 and turn hub 80, but disengages when the lock is barricaded and a key is used to unlock the lockset.

Under normal operation, the side bar 90 rotationally couples spindle 60 and turn hub 80 to one another so that the bolt 42/44 can be extended or retracted by rotating the turn hub assembly with either key 54 or thumb turn 38. The force provided by the biasing member(s) of clutching mechanism 89 is sufficient to maintain side bar 90 in groove 74 without displacement from groove 74 as the turn hub assembly 50 is rotated with the thumb turn 38 or key 54. However, if the spindle 60 is held from rotation by, for example, a person that holds thumb turn 38, then the key 54 can be used to apply sufficient force to compress the biasing member(s) of the clutching mechanism 89 and allow the tapered nose 94 of side bar 90 to ride along the camming surface 75 of groove 74 and displace the side bar 90 into slot 86 until the side bar 90 is moved out of groove 74, such as shown in FIG. 5B. This allows turn hub 80 to rotate relative to the stationary spindle 60 and retract the bolt 42/44. In order to reset the clutching mechanism 89, thumb turn 38 is rotated to cycle spindle 60 within turn hub 80 to re-align side bar 90 with the groove 74 so that the biasing mechanism forces the side bar 90 back into groove 74.

Turn hub assembly 50 is operable so that the lockset 30 can always be locked or unlocked from the outside with a key even if barricaded by holding thumb turn 38. From inside, the thumb turn 38 can always be used to unlock the door since the non-sloped or flat wall 97 contacts the sidewall 77 to allow the rotational force to be transmitted to the turn hub assembly 50 and unlock the lockset 30, providing an always egress type of function. The clutching mechanism 89 provides sufficient force to maintain side bar 90 in engagement with spindle 60 in response to rotational forces applied to thumb turn 38 to lock the lockset 30 provided the lockset is not being unlocked with key 54. The turn hub assembly 50 can be incorporated into a new lockset 30 when installed on a door 12, or provided separately to retrofit an existing lockset.

Various aspects of the present disclosure are contemplated. For example, according to one aspect, an anti-barricading system for a door includes a lockset and a turn hub assembly. The lockset configured for mounting to the door, the lockset includes a lockset housing configured for mounting within the door and at least one bolt mounted for movement relative to the lockset housing between a locked position and an unlocked position. The lockset includes a thumb turn on one side of the door for moving the bolt between the locked position and the unlocked position and a keyway on the other side of the door for receiving a key for moving the bolt between the locked position and the unlocked position. The turn hub assembly is mounted to the lockset and includes a spindle engaged to the thumb turn and a turn hub releasably engaged to the spindle. In an engaged position, rotation of the thumb turn rotates the spindle and the turn hub together to move the bolt between the locked position and the unlocked position and rotation of the key rotates the turn hub and the spindle together to move the bolt between the locked position and the unlocked position. In response to the thumb turn being held from rotation the turn hub disengages from the spindle in response to rotation of the key to rotate the turn hub to move the bolt between the locked position and the unlocked position while the spindle remains stationary.

In one embodiment of the system, the turn hub assembly includes a clutching mechanism that releasably engages the turn hub to the spindle in the engaged position. In a refinement of this embodiment, the clutching mechanism includes an elongated side bar that extends between and releasably engages the turn hub to the spindle in the engaged position. In a further refinement, the spindle includes an axially extending elongated groove and the turn hub includes an axially extending internal slot that aligns with the groove so that the side bar is located in both the groove and the slot in the engaged position. In yet a further refinement, the side bar is retracted into one of the slot and groove to disengage the turn hub from the spindle to allow the turn hub to rotate relative to the spindle. In further refinement, the side bar is biased from one of the slot and groove into the other of the slot and groove in the engaged position. In certain refinements, at least one spring is provided to bias the side bar. In further refinements, the at least one spring is a leaf spring or a pair of coil springs.

In another embodiment of the system, the slot in the turn hub is rectangular and the groove in the spindle includes a sloped sidewall for engaging a tapered nose of the side bar. The sloped sidewall allows the tapered nose of the side bar to slide therealong to displace the side bar into the slot and disengage the turn hub from the spindle while the spindle is held stationary with the thumb turn.

According to another aspect, an anti-barricading turn hub assembly is provided for use with a lockset including a movable bolt. The turn hub assembly includes a spindle that is engaged to a thumb turn of the lockset and a turn hub releasably engaged to the spindle. The turn hub is rotatable by a key from a side of the lockset opposite the spindle. In response to the thumb turn being free to rotate, both the key and the thumb turn are operable to rotate the spindle and the turn hub together to move the bolt between the locked position and the unlocked position. In response to the thumb turn being held from rotation, the turn hub disengages from the spindle to allow the key to rotate the turn hub to move the bolt between the locked position and the unlocked position while the spindle remains stationary.

In one embodiment, the turn hub assembly includes a clutching mechanism that releasably engages the turn hub to the spindle. In a refinement of this embodiment, the clutching mechanism includes an elongated side bar that extends between and releasably engages the turn hub to the spindle. In a further refinement, the spindle includes an axially extending elongated groove and the turn hub includes an axially extending internal slot that aligns with the groove so that the side bar is located in both the groove and the slot in the engaged position. In yet another refinement, the side bar is retracted into one of the slot and the groove to disengage the turn hub from the spindle to allow the turn hub to rotate relative to the spindle.

In one embodiment of the assembly, the side bar is biased outwardly from one of the slot and the groove into the other of the slot and groove in the engaged position. In one refinement, at least one spring is provided in the slot between the turn hub and the side bar to bias the side bar. In one further refinement, the at least one spring is a leaf spring. In another refinement, the at least one spring includes a pair of coil springs.

In another embodiment of the assembly, the slot in the turn hub is rectangular in cross-sectional shape and the groove in the spindle includes a sloped sidewall for engaging a tapered nose of the side bar. The sloped sidewall allows the tapered nose of the side bar to slide therealong to displace the side bar into the slot and disengage the turn hub from the spindle while the spindle is held stationary with the thumb turn.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An anti-barricading system for a door, the system comprising:

a lockset configured for mounting to the door, the lockset including:

a lockset case configured for mounting within the door; and at least one bolt mounted for movement relative to the lockset case between a locked position and an unlocked position, wherein the lockset includes a thumb turn on one side of the door for moving the bolt between the locked position and the unlocked position and a keyway on the other side of the door for receiving a key for moving the bolt between the locked position and the unlocked position; and a turn hub assembly mounted to the lockset, the turn hub assembly including:

a spindle engaged to the thumb turn; and a turn hub releasably engaged to the spindle, wherein in an engaged position rotation of the thumb turn rotates the spindle and the turn hub together to move the bolt between the locked position and the unlocked position and rotation of the key rotates the turn hub and the spindle together to move the bolt between the locked position and the unlocked position, and wherein in response to the thumb turn being held from rotation the turn hub disengages from the spindle in response to rotation of the key to rotate the turn hub to move the bolt between the locked position and the unlocked position while the spindle remains stationary; and wherein the spindle is at all times capable of rotating the turn hub in an unlocking direction such that the thumb turn is at all times capable of driving the at least one bolt from the locked position to the unlocked position.

2. The system of claim 1, further comprising a clutch that releasably engages the turn hub to the spindle in the engaged position.

3. The system of claim 2, wherein the clutch includes an elongated side bar that extends between and releasably engages the turn hub to the spindle in the engaged position.

4. The system of claim 3, wherein the spindle includes an axially extending elongated groove and the turn hub includes an axially extending internal slot that aligns with the groove so that the side bar is located in both the groove and the slot in the engaged position.

5. The system of claim 4, wherein the side bar is retracted into the slot to disengage the turn hub from the spindle to allow the turn hub to rotate relative to the spindle.

6. The system of claim 5, wherein the side bar is biased outwardly from one of the slot and the groove into the other of the slot and the groove in the engaged position.

7. The system of claim 6, further comprising at least one spring for biasing the side bar.

8. The system of claim 7, wherein the at least one spring is a leaf spring.

9. The system of claim 7, wherein the at least one spring includes a pair of coil springs.

10. The system of claim 4, wherein the slot is rectangular and the groove includes a sloped sidewall for engaging a tapered surface of a nose of the side bar and a straight sidewall for engaging a straight surface of the nose of the side bar, wherein the sloped sidewall allows the tapered surface of the side bar to slide therealong to displace the side bar into the slot and disengage the turn hub from the spindle while the spindle is held stationary with the thumb turn and the turn hub is rotated in the unlocking direction by the key, and wherein the straight sidewall engages the straight surface of the side bar to cause rotation of the turn hub in the unlocking direction in response to rotation of the spindle in the unlocking direction by the thumb turn.

11. An anti-barricading turn hub assembly for use with a lockset including a movable bolt, the turn hub assembly comprising:

a spindle that is engaged to a thumb turn of the lockset; and a turn hub releasably engaged to the spindle and the turn hub is rotatable by a key from a side of the lockset opposite the spindle, wherein, in response to the thumb turn being free to rotate in an unlocking direction, both the key and the thumb turn are operable to rotate the spindle and the turn hub together in the unlocking direction to move the bolt from the locked position to the unlocked position, wherein in response to the thumb turn being held from rotation in the unlocking direction the turn hub disengages from the spindle to allow the key to rotate the turn hub in the unlocking direction to move the bolt from the locked position to the unlocked position while the spindle remains stationary, and wherein the spindle is at all times capable of urging the turn hub in the unlocking direction.

12. The assembly of claim 11, further comprising a clutch that releasably engages the turn hub to the spindle.

13. The assembly of claim 12, wherein the clutch includes an elongated side bar that extends between and releasably engages the turn hub to the spindle.

14. The assembly of claim 13, wherein the spindle includes an axially extending elongated groove and the turn hub includes an axially extending internal slot that aligns with the groove so that the side bar is located in both the groove and the slot in the engaged position.

15. The assembly of claim 14, wherein the side bar is retracted into one of the slot and groove to disengage the turn hub from the spindle to allow the turn hub to rotate relative to the spindle.

16. The assembly of claim 15, wherein the side bar is biased from one of the slot and the groove into the other of the slot and groove in the engaged position.

17. The assembly of claim 16, further comprising at least one spring for biasing the side bar.

18. The assembly of claim 17, wherein the at least one spring is a leaf spring.

19. The assembly of claim 17, wherein the at least one spring includes a pair of coil springs.

20. The assembly of claim 14, wherein the slot is rectangular and the groove includes a sloped sidewall for engaging a tapered nose of the side bar, wherein the sloped sidewall allows the tapered nose of the side bar to slide therealong to displace the side bar into the slot and disengage the turn hub from the spindle to unlock the bolt by rotating the turn hub while the spindle is held stationary with the thumb turn.

21. The assembly of claim 20, wherein the groove includes a straight sidewall that is opposite the sloped sidewall that abuttingly engages a flat sidewall of the side bar in response to rotation of the thumb turn to unlock the bolt.

22. An anti-barricading turn hub assembly for use with a lockset including a movable bolt, the turn hub assembly comprising:

a spindle that is engaged to a thumb turn of the lockset;

a turn hub releasably engaged to the spindle, wherein the turn hub is rotatable by a key from a side of the lockset opposite the spindle; and a clutch selectively coupling the spindle and the turn hub for joint rotation in an unlocking direction;

wherein the clutch has a coupling state in response to the thumb turn being free to rotate in the unlocking direction, the clutch in the coupling state coupling the spindle and the turn hub for joint rotation in the unlocking direction by either of the key and the thumb turn;

wherein the clutch is configured to move from the coupling state to a decoupling state in response to rotation of the turn hub in the unlocking direction by the key when the thumb turn is blocked from rotating in the unlocking direction, the clutch in the decoupling state permitting the key to rotate the turn hub in the unlocking direction while the thumb turn remains stationary;

wherein the clutch in the coupling state is configured to remain in the coupling state in response to rotation of the thumb turn in the unlocking direction such that the thumb turn remains operable to rotate the turn hub in the unlocking direction; and wherein the clutch is configured to at all times transmit torque in the unlocking direction from the spindle to the turn hub.

23. The anti-barricading turn hub assembly of claim 22, wherein the clutch comprises:

a slot formed in one of the turn hub or the spindle;

a groove formed in the other of the turn hub or the spindle, the groove including a straight sidewall and a tapered sidewall; and a side bar seated in the slot, a nose of the side bar including a flat surface and a tapered surface;

wherein with the clutch in the coupling state, the nose is received in the groove such that the flat surface faces the straight sidewall and the tapered surface faces the tapered sidewall; and wherein with the clutch in the decoupling state, the nose is removed from the groove.

24. The anti-barricading turn hub assembly of claim 23, wherein when the thumb turn is blocked from rotating in the unlocking direction, rotation of the turn hub in the unlocking direction causes engagement between the tapered sidewall and the tapered surface to urge the nose out of the groove; and wherein with the clutch in the coupling state, rotation of the spindle in the unlocking direction by the thumb turn is transmitted to the turn hub via engagement of the straight sidewall and the flat surface.

* * * * *